US007377242B2

(12) United States Patent
Uehama et al.

(10) Patent No.: US 7,377,242 B2
(45) Date of Patent: May 27, 2008

(54) VALVE TIMING ADJUSTING APPARATUS

(75) Inventors: Motoki Uehama, Kariya (JP); Yasushi Morii, Nagoya (JP)

(73) Assignee: Denso Corporation, Kariya, Aichi-pref. (JP)

( * ) Notice: Subject to any disclaimer, the term of this patent is extended or adjusted under 35 U.S.C. 154(b) by 99 days.

(21) Appl. No.: 11/515,247

(22) Filed: Sep. 5, 2006

(65) Prior Publication Data

US 2007/0051332 A1 Mar. 8, 2007

(30) Foreign Application Priority Data

Sep. 5, 2005 (JP) ..... 2005-256777

(51) Int. Cl.
*F01L 1/34* (2006.01)

(52) U.S. Cl. ..... 123/90.17; 123/90.31; 464/160

(58) Field of Classification Search ..... 123/90.11, 123/90.15, 90.16, 90.17, 90.18, 90.27, 90.31; 464/1, 2, 160; 251/129.01
See application file for complete search history.

(56) References Cited

U.S. PATENT DOCUMENTS 6,637,389 B2 10/2003 Schafer et al.
6,848,401 B2 2/2005 Takenaka et al.
6,883,482 B2 4/2005 Takenaka et al.
7,100,556 B2 9/2006 Sugiura
7,308,876 B2 * 12/2007 Schafer et al. ..... 123/90.17
7,311,071 B2 * 12/2007 Yamanaka ..... 123/90.17

FOREIGN PATENT DOCUMENTS

DE 41 10 195 C2 2/2000
JP 9-60509 3/1997

OTHER PUBLICATIONS

Notice of Allowance dated Oct. 10, 2007, in related U.S. Appl. No. 11/515,200.
U.S. Ser. No. 11/515,200; Filed Sep. 5, 2006; Inv: Uehama et al; JP counterpart JP 2005-256799.
U.S. Ser. No. 11/514,943; Filed Sep. 5, 2006; Inv: Uehama et al; JP counterpart JP 2005-256778.

* cited by examiner

*Primary Examiner*—Ching Chang
(74) *Attorney, Agent, or Firm*—Nixon & Vanderhye P.C.

(57) ABSTRACT

A driving-side rotatable body includes a driving-side inner gear, which has an axial extent that does not overlap with an axial extent of a driven-side inner gear of a driven-side rotatable body. A driven-side outer gear and a driving-side outer gear of a planet gear are meshed with and are driven together with the driven-side inner gear and the driving-side inner gear, so that the planet gear changes a relative rotational phase between the driven-side rotatable body and the driving-side rotatable body. The driven-side rotatable body supports the driving-side rotatable body from a radially inner side of the driving-side rotatable body at a location, which is radially outward of the driven-side inner gear.

9 Claims, 5 Drawing Sheets

VALVE TIMING ADJUSTING APPARATUS

CROSS REFERENCE TO RELATED APPLICATION

This application is based on and incorporates herein by reference Japanese Patent Application No. 2005-256777 filed on Sep. 5, 2005. This application is also related to U.S. application Ser. No. 11/514,943, entitled "VALVE TIMING ADJUSTING APPARATUS," filed on Sep. 5, 2006 and U.S. application Ser. No. 11/515,200, entitled "VALVE TIMING ADJUSTING APPARATUS," filed on Sep. 5, 2006.

BACKGROUND OF THE INVENTION

1. Field of the Invention

The present invention relates to a valve timing adjusting apparatus that adjusts valve timing of at least one of an intake valve and an exhaust valve of an internal combustion engine that are opened and closed by a camshaft upon transmission of a torque from a crankshaft.

2. Description of Related Art

In one known valve timing adjusting apparatus, the valve timing is adjusted by changing a relative rotational phase between two rotatable bodies, which are rotated synchronously with the crankshaft and the camshaft, respectively. For example, DE4110195C2 discloses a valve timing adjusting apparatus, which changes a relative rotational phase between two rotatable bodies through use of a differential gear mechanism, which includes a planet gear as its main component. Specifically, in the apparatus of DE4110195C2, two inner gears are provided to the rotatable body synchronized with the crankshaft and the rotatable body synchronized with the camshaft, respectively, and axial extents of these two inner gears do not overlap with each other. These inner gears are meshed with two outer gears, respectively, of the planet gear. In this way, a large speed reducing ratio can be obtained with the compact design.

In the apparatus disclosed in DE4110195C2, an inner peripheral wall of the crankshaft side rotatable body, which is rotated synchronously with the crankshaft, is engaged with an outer peripheral wall of the camshaft, so that the crankshaft side rotatable body is supported by the camshaft from a radially inner side of the crankshaft side rotatable body. In the above structure, an appropriate clearance should be provided between the crankshaft side rotatable body and the camshaft to permit the relative rotation between the crankshaft side rotatable body and the camshaft.

However, in the apparatus disclosed in DE4110195C2, the support position of the crankshaft side rotatable body by the camshaft is axially spaced from the inner gear of the camshaft side rotatable body, which is rotated synchronously with the camshaft. In the case of the above supporting structure, when the gravity is applied to the differential gear mechanism, in which the inner gear of the camshaft side rotatable body and the inner gear of the crankshaft side rotatable body are connected with one another through the planet gear, the crankshaft side rotatable body is tilted relative to the camshaft by the amount that corresponds to the clearance between the crankshaft side rotatable body and the camshaft. In this case, the crankshaft side rotatable body is locally engaged with the camshaft, so that wearing and seizing between the crankshaft side rotatable body and the camshaft are likely to occur. Furthermore, in the above supporting structure, when an oscillating torque of the camshaft is transmitted to the differential gear mechanism, the crankshaft side rotatable body is wobbled by the amount that corresponds to the clearance between the crankshaft side rotatable body and the camshaft. In this case, the crankshaft side rotatable body is wobbled relative to the camshaft, so that noise and a damage could possibly occur.

SUMMARY OF THE INVENTION

The present invention addresses the above disadvantages. Thus, it is an objective of the present invention to provide a valve timing adjusting apparatus, which achieves an improved durability. It is another objective of the present invention to provide a valve timing adjusting apparatus, which limits generation of noise.

To achieve the objectives of the present invention, there is provided a valve timing adjusting apparatus that adjusts valve timing of at least one of an intake valve and an exhaust valve of an internal combustion engine, which are opened and closed by a camshaft upon transmission of a torque from a crankshaft to the camshaft. The valve timing adjusting apparatus includes a first rotatable body, a second rotatable body and a planet gear. The first rotatable body includes a first inner gear and is rotated synchronously with one of the crankshaft and the camshaft. The second rotatable body includes a second inner gear, which has an axial extent that does not overlap with an axial extent of the first inner gear, wherein the second rotatable body is rotated synchronously with the other one of the crankshaft and the camshaft. The planet gear includes a first outer gear and a second outer gear. The first outer gear and the second outer gear are meshed with and are driven together with the first inner gear and the second inner gear, respectively, to have a sun-and-planet motion, so that the planet gear changes a relative rotational phase between the first rotatable body and the second rotatable body. The first rotatable body supports the second rotatable body from a radially inner side of the second rotatable body at a location, which is radially outward of the first inner gear.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF THE INVENTION

Various embodiments of the present invention will be described with reference to the accompanying drawings.

FIRST EMBODIMENT

Figure 1:
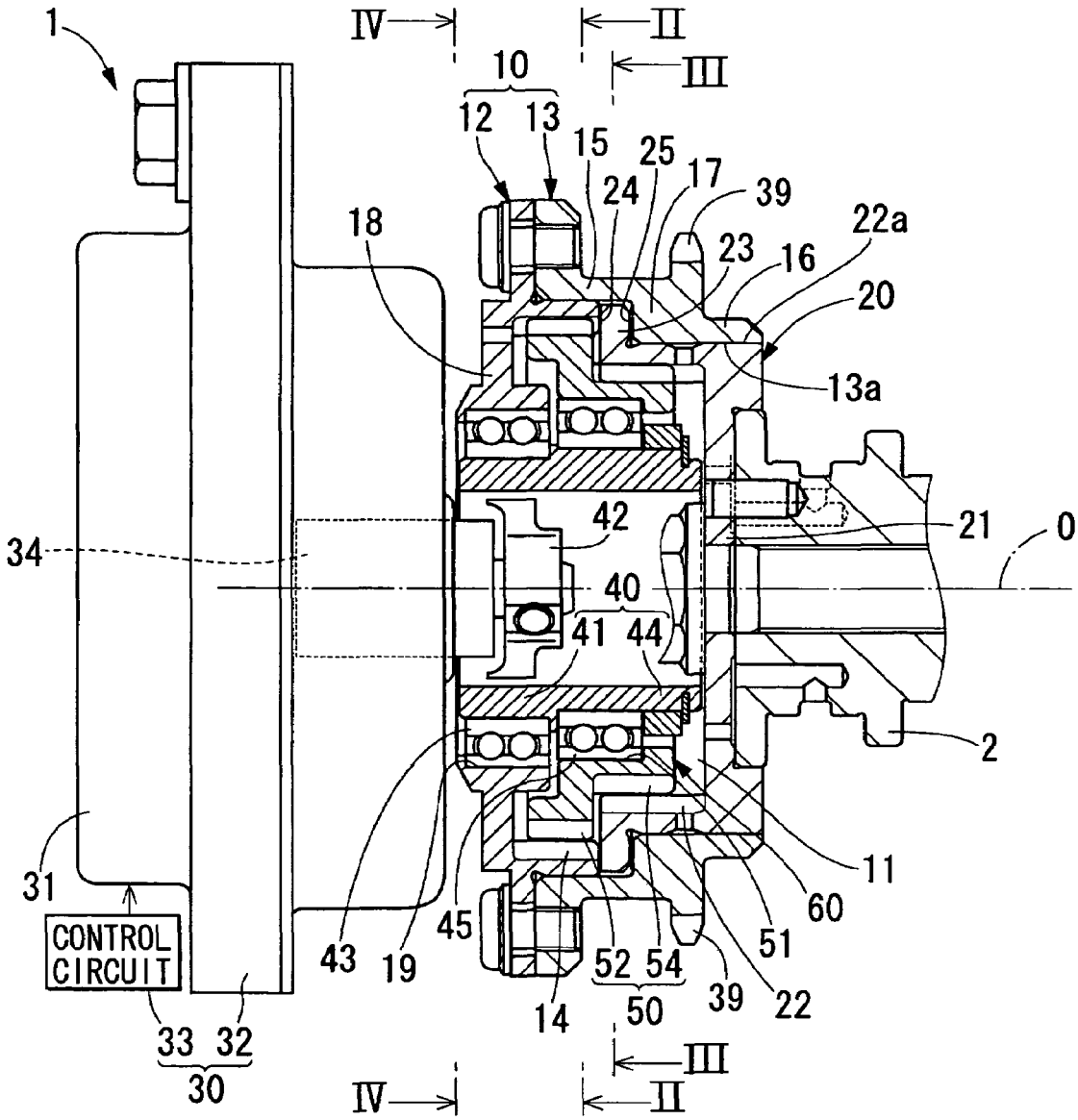
FIG. 1 is a cross sectional view taken along line I-I in FIG. 2, showing a valve timing adjusting apparatus according to a first embodiment.

FIG. 1 shows a valve timing adjusting apparatus 1 according to a first embodiment of the present invention. The valve timing adjusting apparatus 1 is provided in a transmission system, which transmits an engine torque from a crankshaft of an internal combustion engine to a camshaft 2. The valve timing adjusting apparatus 1 changes a relative rotational phase between the crankshaft and the camshaft 2 to adjust valve timing of an intake valve of the internal combustion engine. In FIG. 1, a top-to-bottom direction corresponds to the actual vertical direction, and a left-to-right direction, along which a rotational axis O extends, corresponds to the actual horizontal direction.

The valve timing adjusting apparatus 1 includes a driving-side rotatable body 10, a driven-side rotatable body 20, a control unit 30, a planet carrier 40 and a planet gear 50.

The driving-side rotatable body 10 and the driven-side rotatable body 20 cooperate together to form a receiving space 11, which receives the planet carrier 40 and the planet gear 50.

Figure 2:
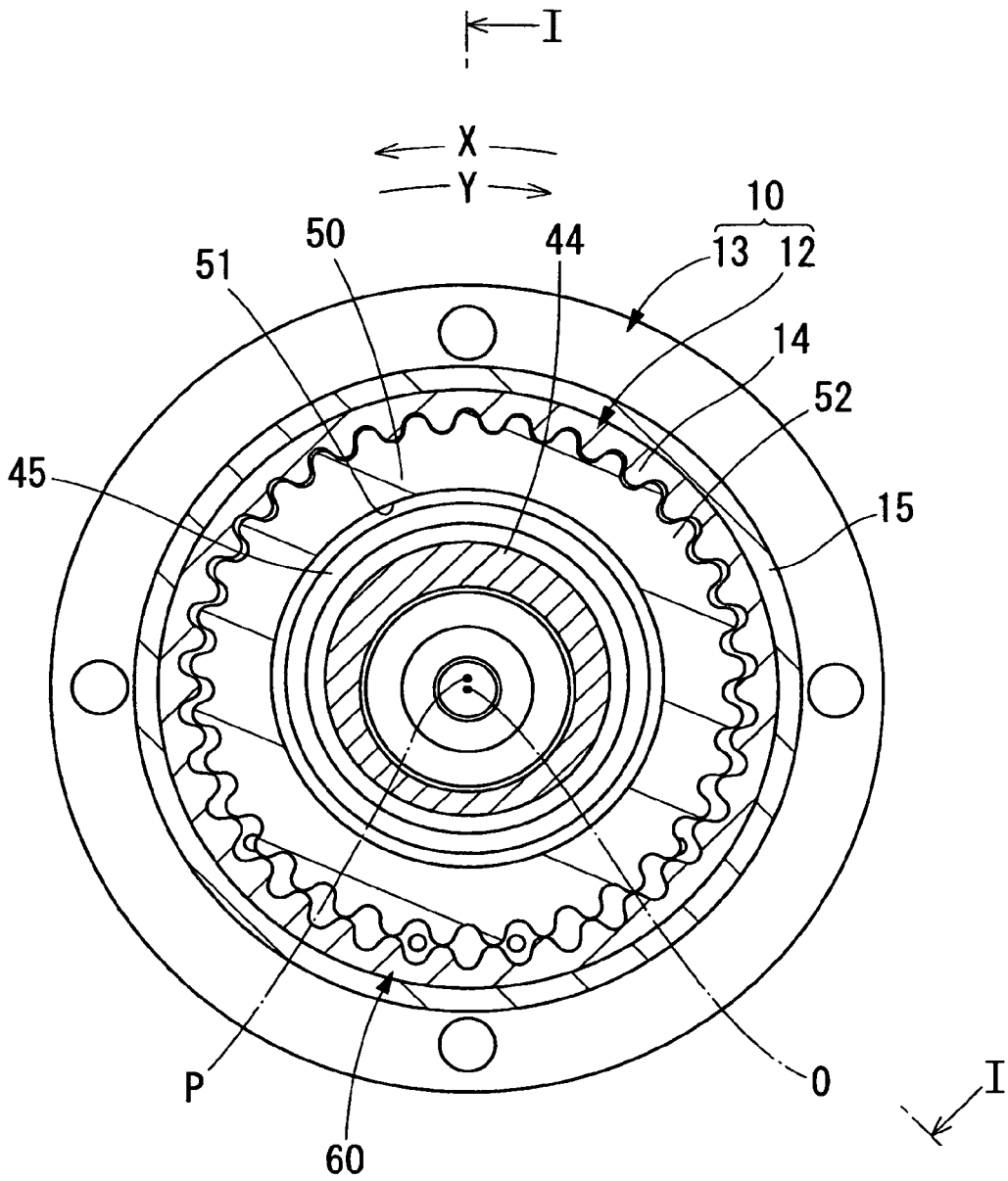
FIG. 2 is a cross sectional view taken along line II-II in FIG. 1.

As shown in FIGS. 1 and 2, the driving-side rotatable body 10 includes a cup shaped gear member 12 and a double-stepped cylindrical sprocket 13, which are coaxially arranged relative to each other. A peripheral wall of the gear member 12 forms a driving-side inner gear 14, which has an addendum circle positioned radially inward of its dedendum circle. The gear member 12 is fixed to the sprocket 13 by screws in a state where an outer peripheral wall of the driving-side inner gear 14 is engaged with an inner peripheral wall of a large diameter portion 15 of the sprocket 13. In the sprocket 13, a stepped portion 17, which connects between the large diameter portion 15 and a small diameter portion 16, includes a plurality of teeth 39, which project radially outward. An annular timing chain is wound around the teeth 39 and teeth of the crankshaft. Therefore, when the engine torque, which is outputted from the crankshaft, is supplied to the sprocket 13 through the timing chain, the driving-side rotatable body 10 is driven synchronously with the crankshaft and is thereby rotated about the rotational axis O while maintaining the relative phase with respect to the crankshaft. At this time, a rotational direction of the driving-side rotatable body 10 is a counterclockwise direction in FIG. 2.

Figure 3:
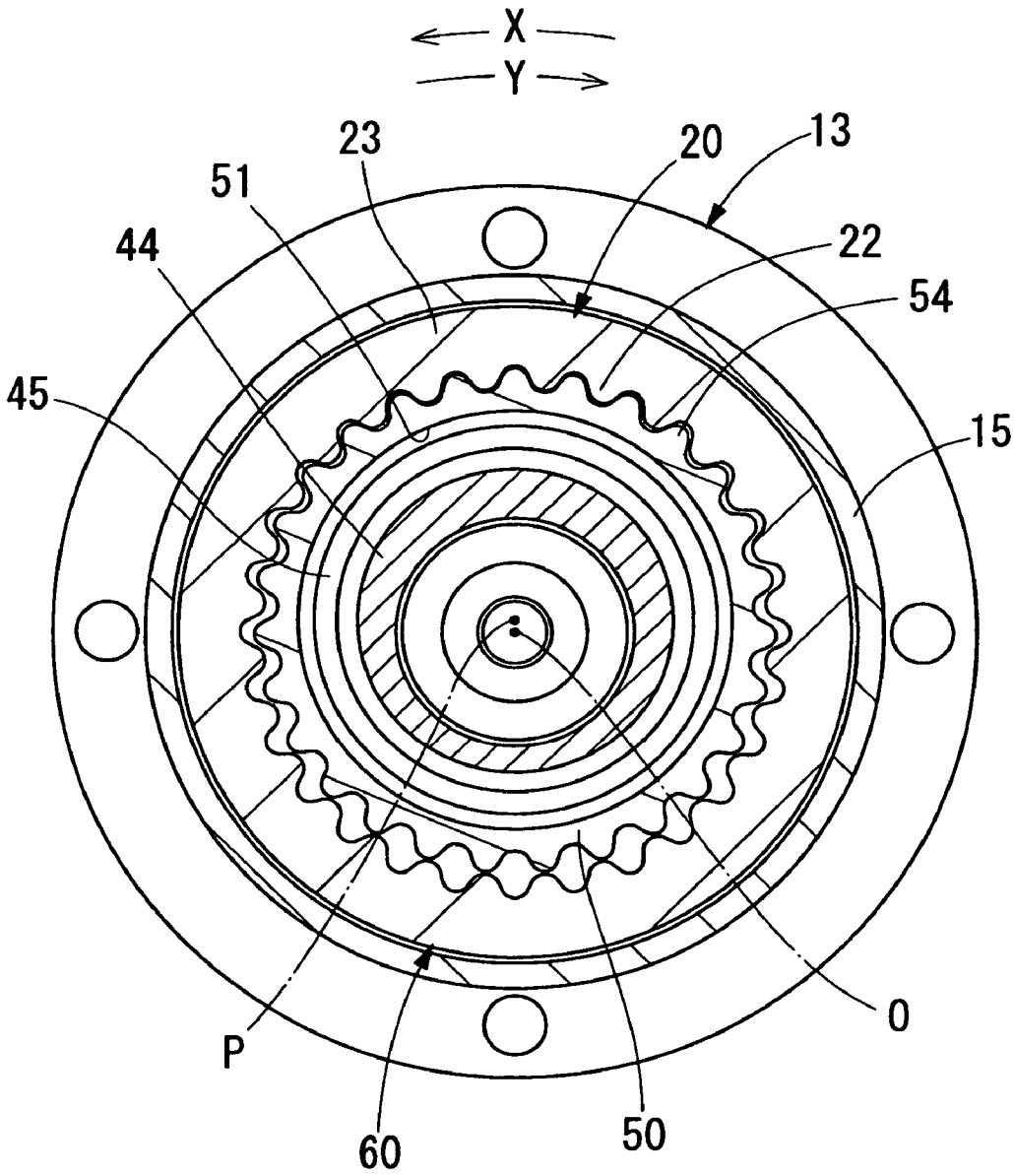
FIG. 3 is a cross sectional view taken along line III-III in FIG. 1.

As shown in FIGS. 1 and 3, the driven-side rotatable body 20 is a cup-shaped body and is arranged coaxial to the driving-side rotatable body 10 and the camshaft 2. A bottom wall of the driven-side rotatable body 20 forms a fixing portion 21, which is fixed to one axial end of the camshaft 2 by bolts. The driven-side rotatable body 20, which is supported by the camshaft 2 through the fixation with the bolts, can be rotated synchronously with the camshaft 2 about the rotational axis O while maintaining the relative rotational phase with respect to the camshaft 2. Furthermore, the driven-side rotatable body 20 is relatively rotatable with respect to the driving-side rotatable body 10. In the following description, a relative rotational direction, in which the driven-side rotatable body 20 is advanced relative to the driving-side rotatable body 10, will be referred to as an advancing direction X. In contrast, an opposite relative rotational direction, in which the driven-side rotatable body 20 is retarded relative to the driving-side rotatable body 10, will be referred to as a retarding direction Y.

A peripheral wall of the driven-side rotatable body 20 forms a driven-side inner gear 22, which has an addendum circle positioned radially inward of its dedendum circle. An inner diameter of the driven-side inner gear 22 is smaller than an inner diameter of the driving-side inner gear 14. Furthermore, the number of the teeth of the driven-side inner gear 22 is smaller than the number of the teeth of the driving-side inner gear 14. An outer peripheral wall 22*a* of the driven-side inner gear 22 is engaged with an inner peripheral wall 13*a* of the sprocket 13 at the small diameter portion 16 and the stepped portion 17. A small clearance is formed between the outer peripheral wall 22*a* and the inner peripheral wall 13*a* to allow relative rotation between the driven-side inner gear 22 and the sprocket 13. With this engaging structure, the driven-side rotatable body 20 relatively rotatably supports the driving-side rotatable body 10 from a radially inner side of the driving-side rotatable body 10 at a location, which is radially outward of the driven-side inner gear 22.

An axial end portion of the driven-side inner gear 22, which is opposite from the fixing portion 21, includes a flange 23, which projects radially outward. The flange 23 is clamped between an end surface 24 of the driving-side inner gear 14 and an end surface 25 of the stepped portion 17, which are axially opposed to each other. A small clearance is formed between the end surface 24 and the flange 23 and also between the flange 23 and the end surface 25 to allow relative rotation between the flange 23 and the driving-side inner gear 14 and also between the flange 23 and the stepped portion 17. With this clamping structure, the driven-side rotatable body 20 is relatively rotatably engaged with the end surfaces 24, 25, which are opposed to each other in the axial direction of the driving-side rotatable body 10. By axially clamping the flange 23 between the driving-side inner gear 14 and the stepped portion 17, the driven-side inner gear 22 and the driving-side inner gear 14 are placed adjacent to each other in such a manner that an axial extent of the driven-side inner gear 22 and an axial extent of the driving-side inner gear 14 do not overlap with each other. Furthermore, the axial relative movement of the driving-side rotatable body 10 with respect to the driven-side rotatable body 20 is limited.

As shown in FIG. 1, the control unit 30 includes an electric motor 32 and a power supply control circuit 33. The electric motor 32 is arranged on an opposite side of the rotatable bodies 10, 20, which is opposite from the camshaft 2. The electric motor 32 may be, for example, a brushless motor and includes a motor case 31 and a motor shaft 34. The motor case 31 is fixed to the internal combustion engine through a stay (not shown), and the motor shaft 34 is supported by the motor case 31 in such a manner that the motor shaft 34 is rotatable in a normal direction and a reverse direction. The power supply control circuit 33 is an electric circuit, such as a microcomputer, and is arranged outside or inside of the motor case 31 such that the power supply control circuit 33 is electrically connected to the electric motor 32. The power supply control circuit 33 controls the power supply to a coil (not shown) of the electric motor 32 based on, for example, an operational state of the internal combustion engine. Through this power supply control, the electric motor 32 forms a rotating magnetic field around the motor shaft 34, so that the electric motor 32 outputs a rotational torque from the motor shaft 34 in the corresponding direction X or Y (see FIG. 4), which corresponds to the direction of the rotating magnetic field.

Figure 4:
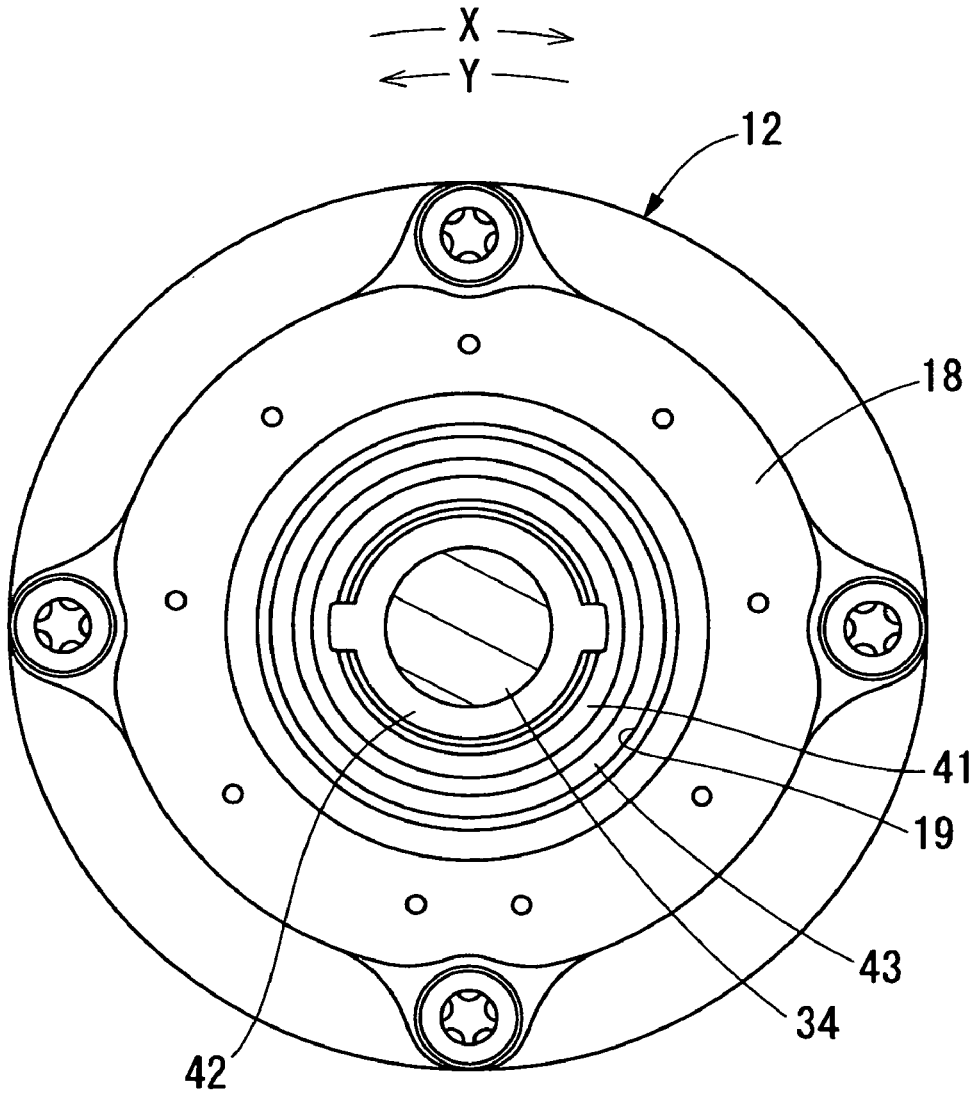
FIG. 4 is a cross sectional view taken along line IV-IV in FIG. 1.

As shown in FIGS. 1 and 4, an input portion 41 of the planet carrier 40 is a cylindrical body, which is coaxial with the rotatable bodies 10, 20 and the shafts 2, 34. The input portion 41 of the planet carrier 40 is fixed to the motor shaft 34 through a coupling 42. Through this fixation, the planet carrier 40 can be rotated synchronously with the motor shaft 34. Furthermore, the planet carrier 40 is relatively rotatable with respect to the driving-side rotatable body 10. The input portion 41 is arranged inside a central hole 19, which axially penetrates through a bottom wall 18 of the gear member 12.

Furthermore, the input portion 41 supports the driving-side rotatable body 10 on the radially inner side of the driving-side rotatable body 10 through a bearing 43.

As shown in FIGS. 1 and 2, an eccentric portion 44 of the planet carrier 40, which is located on a fixing portion 21 side of the input portion 41, is a cylindrical body, which has an outer peripheral wall that is eccentric to the rotatable bodies 10, 20 and the shafts 2, 34. The eccentric portion 44 is arranged inside a central hole 51, which axially penetrates through the planet gear 50. The eccentric portion 44 supports the planet gear 50 on a radially inner side of the planet gear 50 through a bearing 45. Through this support, the planet gear 50 can rotate about an eccentric axis P, which is a central axis of the outer peripheral wall of the eccentric portion 44, and can revolve in the rotational direction of the eccentric portion 44. Specifically, the planet gear 50 is arranged to have a sun-and-planet motion.

As shown in FIGS. 1 to 3, the planet gear 50 is a double stepped cylindrical body and forms a driving-side outer gear 52 and a driven-side outer gear 54 at its large diameter portion and a small diameter portion, respectively. Each of the driving-side outer gear 52 and the driven-side outer gear 54 has an addendum circle positioned radially outward of its dedendum circle. Here, the number of teeth of the driving-side outer gear 52 is set to be smaller than the number of teeth of the driving-side inner gear 14 by a predetermined number N (one in this instance). Furthermore, the number of teeth of the driven-side outer gear 54 is set to be smaller than the number of teeth of the driven-side inner gear 22 by the predetermined number N. Therefore, the number of the teeth of the driven-side outer gear 54 is smaller than the number of the teeth of the driving-side outer gear 52. The driving-side outer gear 52 is arranged radially inward of the driving-side inner gear 14 to mesh with a portion of the driving-side inner gear 14. The driven-side outer gear 54, which is located on a fixing portion 21 side of the driving-side outer gear 52, is arranged radially inward of the driven-side inner gear 22 to mesh with a portion of the driven-side inner gear 22. Here, it should be understood that each inner gear 14, 22 is located radially outward of the corresponding outer gear 52, 54 and has gear teeth, which extend radially inward. Likewise, each outer gear 52, 54 is located radially inward of the corresponding inner gear 14, 22 and has gear teeth, which extend radially outward.

With the above construction, the driving-side inner gear 14 and the driven-side inner gear 22 are connected through the planet gear 50 at the radially outward of the eccentric portion 44 to form a differential gear mechanism 60 in the internal space 11 of the rotatable bodies 10, 20. In the differential gear mechanism 60, when the planet carrier 40 does not rotate relative to the driving-side rotatable body 10, the planet gear 50 rotates together with the rotatable bodies 10, 20 while maintaining the meshed position between the outer gears 52, 54 and the inner gears 14, 22. In this way, the relative rotational phase between the rotatable bodies 10, 20 is maintained, so that the valve timing is also maintained. When the planet carrier 40 is rotated relative to the driving-side rotatable body 10 in the advancing direction X due to an increase in the rotational torque in the direction X, the planet gear 50 makes the sun-and-planet motion while changing the meshed position between the outer gears 52, 54 and the inner gears 14, 22, so that the driven-side rotatable body 20 is rotated relative to the driving-side rotatable body 10 in the advancing direction X. Therefore, the valve timing is advanced. When the planet carrier 40 is rotated relative to the driving-side rotatable body 10 in the retarding direction Y due to an increase in the rotational torque in the direction Y, the planet gear 50 makes the sun-and-planet motion while changing the meshed position between the outer gears 52, 54 and the inner gears 14, 22, so that the driven-side rotatable body 20 is rotated relative to the driving-side rotatable body 10 in the retarding direction Y. Therefore, the valve timing is retarded.

When the gravity is applied to the differential gear mechanism 60 and the planet carrier 40, the driving-side rotatable body 10 could possibly be tilted relative to the driven-side rotatable body 20 in accordance with the clearance between the outer peripheral wall 22*a* of the driven-side inner gear 22 and the inner peripheral wall 13*a* of the sprocket 13. However, in the case of the present embodiment where the driven-side rotatable body 20, which is supported by the camshaft 2, supports the driving-side rotatable body 10 at the radially outward of the driven-side inner gear 22, this support position for supporting the driving-side rotatably body 10 by the driven-side rotatable body 20 is close to and is overlapped with the driven-side inner gear 22 in the radial direction, so that the tilting of the driving-side rotatable body 10 relative to the driven-side rotatable body 20 is limited. Here, when the gravity is applied to the differential gear mechanism 60 and the planet carrier 40, the driving-side rotatable body 10 could possibly be tilted relative to the driven-side rotatable body 20 in accordance with the clearance between the end surface 24 of the driving-side inner gear 14 and the flange 23 and also the clearance between the end surface 25 of the stepped portion 17 and the flange 23. However, in the case of the present embodiment where the driven-side rotatable body 20, which is supported by the camshaft 2, engages the end surfaces 24, 25 of the driving-side rotatable body 10 at the radially outward of the driven-side inner gear 22, these engaging positions are close to and are overlapped with the driven-side inner gear 22 in the radial direction, so that the tilting of the driving-side rotatable body 10 relative to the driven-side rotatable body 20 is further limited.

Therefore, due to the limitation of the tilting, it is possible to limit localized engagement between the rotatable bodies 10, 20 and thereby to limit wearing and seizing of the rotatable bodies 10, 20.

Furthermore, when the oscillating torque of the camshaft 2 is transmitted to the differential gear mechanism 60 and the planet carrier 40, the driving-side rotatable body 10 could possibly be wobbled in accordance with the clearance between outer peripheral wall 22*a* of the driven-side inner gear 22 and the inner peripheral wall 13*a* of the sprocket 13. However, in the present embodiment, the driven-side rotatable body 20, which is supported by the camshaft 2, supports the driving-side rotatable body 10 at the radially outward of the driven-side inner gear 22, so that this support position for supporting the driving-side rotatably body 10 by the driven-side rotatable body 20 is close to and is overlapped with the driven-side inner gear 22 in the radial direction, and thereby the wobbling of the driving-side rotatable body 10 can be limited. Furthermore, when the oscillating torque is transmitted to, for example, the differential gear mechanism 60 and the planet carrier 40, the driving-side rotatable body 10 could possibly be wobbled in accordance with the clearance between the end surface 24 of the driving-side inner gear 14 and the flange 23 and also the clearance between the end surface 25 of the stepped portion 17 and the flange 23. However, in the present embodiment, the driven-side rotatable body 20, which is supported by the camshaft 2, engages the end surfaces 24, 25 of the driving-side rotatable body 10 at the radially outward of the driven-side inner gear 22, so that these engaging positions are close to and are overlapped with the driven-side inner gear 22 in the radial direction, so that the wobbling of the driving-side rotatable body 10 can be further limited.

Accordingly, the above wobbling limiting effect can limit the wobbling of the driving-side rotatable body 10 relative to the driven-side inner gear 22 and thereby limit generation of noise and damage.

Furthermore, an axial extent of the engaged section between the outer peripheral wall 22*a* of the driven-side rotatable body 20 and the inner peripheral wall 13*a* of the driving-side rotatable body 10 at least partially overlaps with an axial extent of the camshaft 2, as shown in FIG. 1. With this structure, the gravity applied to the valve timing adjusting apparatus 1 and the tension of the timing chain can be effectively supported by the camshaft 2, so that the stress applied to the gears 22, 54 can be effectively reduced.

As a result, the durability of the valve timing adjusting apparatus 1 is improved, and thereby the accurate valve timing adjustment in the rotational torque control operation of the control unit 30 can be maintained for a long time period.

In the first embodiment, the driven-side rotatable body 20 corresponds to a first rotatable body of the present invention, and the driving-side rotatable body 10 corresponds to a second rotatable body of the present invention. Furthermore, the driven-side inner gear 22 corresponds to a first inner gear of the present invention, and the driving-side inner gear 14 corresponds to a second inner gear of the present invention. In addition, the driven-side outer gear 54 corresponds to a first outer gear of the present invention, and the driving-side outer gear 52 corresponds to a second outer gear of the present invention. Also, the end surface 24 of the driving-side inner gear 14 corresponds to a specific wall surface or a first wall surface of the present invention, and the end surface 25 of the stepped portion 17 corresponds to the specific wall surface or a second wall surface of the present invention.

SECOND EMBODIMENT

Figure 5:
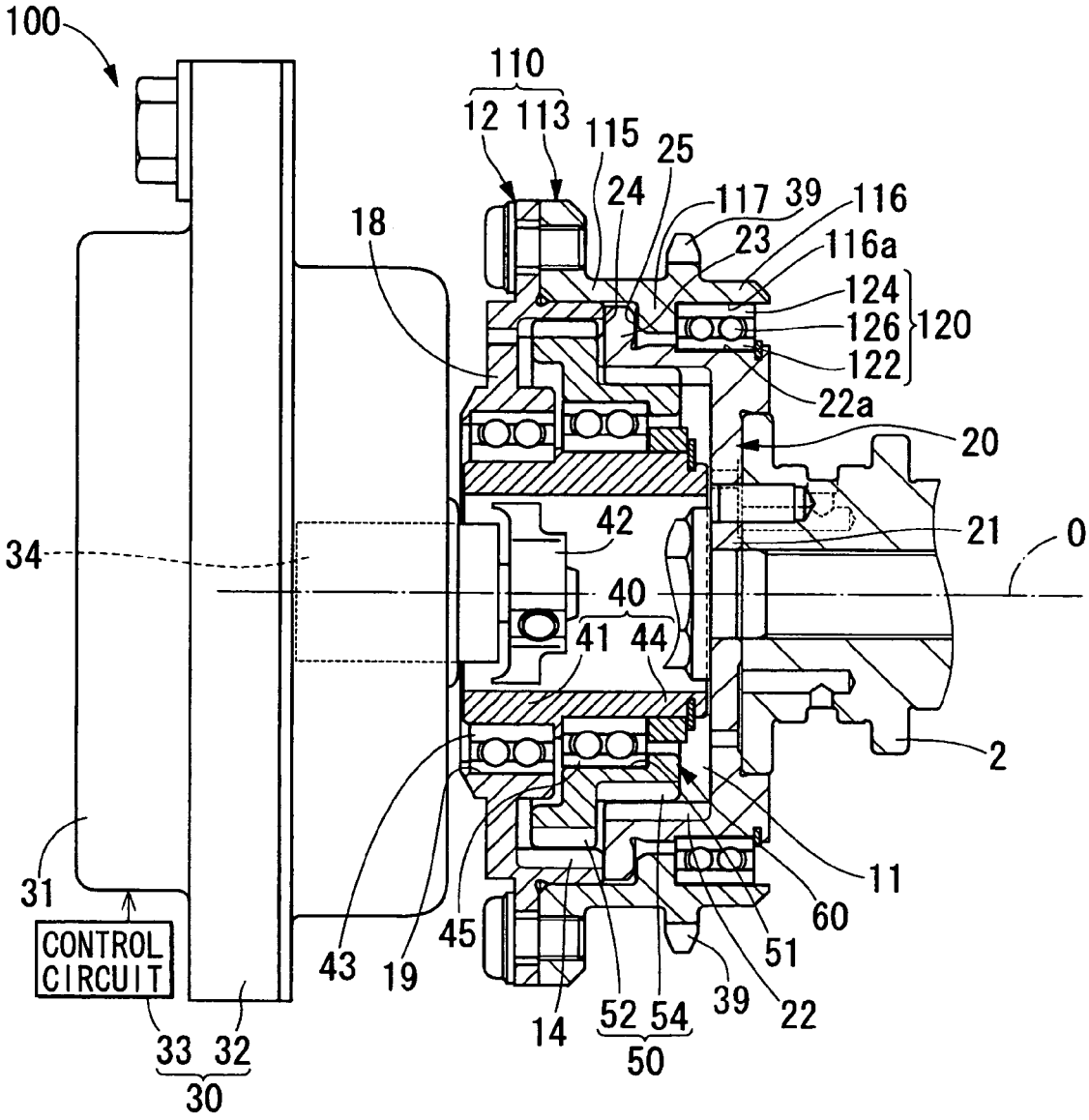
FIG. 5 is a cross sectional view similar to FIG. 1, showing a valve timing adjusting apparatus according to a second embodiment.

As shown in FIG. 5, a second embodiment of the present invention is a modification of the first embodiment, and therefore components similar to those of the first embodiment will be indicated by the same numerals and will not be described further.

A sprocket 113 of a driving-side rotatable body 110 of a valve timing adjusting apparatus 100 according to the second embodiment includes first to third cylindrical portions 115-117. The first cylindrical portion 115 and the third cylindrical portion 117 have the substantially the same construction as the large diameter portion 15 and the stepped portion 17, respectively, of the first embodiment. The second cylindrical portion 116 is formed in a cylindrical body, which has a diameter larger than that of the small diameter portion 16. A bearing 120 is interposed between an inner peripheral wall 116*a* of the second cylindrical portion 116 and the outer peripheral wall 22*a* of the driven-side inner gear 22.

The bearing 120 is a radial bearing that has spherical rolling elements 126, which are clamped between an inner ring 122 and an outer ring 124. The inner ring 122 is securely engaged with the outer peripheral wall 22*a* of the driven-side inner gear 22 and thereby rotates integrally with the driven-side rotatable body 20. The outer ring 124 is securely engaged with the inner peripheral wall 116*a* of the second cylindrical portion 116 and thereby rotates integrally with the driving-side rotatable body 110. A small clearance is provided between each rolling element 126 and each of the inner and outer rings 122, 124 to allow relative rotation between the inner ring 122 and the outer ring 124.

As shown in FIG. 5, even in this valve timing adjusting apparatus 100, the driven-side rotatable body 20 supports the driving-side rotatable body 110 at the radially outward of the driven-side inner gear 22 and is engaged with the end surfaces 24, 25 of the driving-side rotatable body 110. Therefore, the tilting and the wobbling of the driving-side rotatable body 110, which is caused by the clearance between each rolling element 126 and each of the inner and outer rings 122, 124 can be limited in the manner similar to that of the first embodiment. Therefore, the disadvantages (e.g., wearing, seizing, noise, and damage) can be limited with the valve timing adjusting apparatus 100, and thereby the accurate valve timing adjustment can be maintained for a long time period.

In the second embodiment, a combination of the driven-side rotatable body 20 and the inner ring 122 corresponds to a first rotatable body of the present invention, and a combination of the driving-side rotatable body 110 and the outer ring 124 corresponds to a second rotatable body of the present invention.

The various embodiments are described above. However, the present invention is not limited to the above embodiments and can be implemented in various other forms without departing the scope and spirit of the present invention.

For example, in the first and second embodiments, the valve timing adjusting apparatus 1, 100, which adjusts the valve timing of the intake valve, is described. However, the present invention can be implemented in an apparatus, which adjusts valve timing of an exhaust valve or in an apparatus, which adjusts both of the intake valve and the exhaust valve.

Furthermore, in the first and second embodiments, there is described the valve timing adjusting apparatus 1, 100, in which the rotatable body 10, 110 is driven synchronously with the crankshaft, and the rotatable body 20 is rotated synchronously with the camshaft 2. Alternatively, the rotatable body 10, 110 may be driven synchronously with the camshaft 2, and the rotatable body 20 may be driven synchronously with the crankshaft.

Furthermore, in the first and second embodiments, the driven-side rotatable body 20 is fixed to and is supported by the camshaft 2 through the bolts. However, the driven-side rotatable body 20 may be connected to the camshaft 2 through a rotation transmitting member (e.g., a timing chain, a timing belt), so that the driven-side rotatable body 20 is not supported by the camshaft 2.

Furthermore, in the first and second embodiments, the sprocket 13, 113 is provided to the driving-side rotatable body 10, 110, and the driving-side rotatable body 10, 110 is connected to the crankshaft through the timing chain. Alternatively, for example, a pulley may be provided to the driving-side rotatable body 10, 110, and the driving-side rotatable body 10, 110 may be connected to the crankshaft through a rotation transmitting member (e.g., a timing belt).

Furthermore, in the first embodiment, only one of the end surfaces 24, 25 may be engaged with the flange 23, and the other one of the end surfaces 24, 25 may be spaced from the flange 23. Also, the engagement between the end surfaces 24, 25 and the flange 23 may be entirely eliminated.

Also, in the first embodiment, a hollow recess may be provided between the end surfaces of the flange 23, which are engaged with the end surfaces 24, 25, respectively.

Furthermore, in the second embodiment, in place of the spherical rolling elements 126, cylindrical rolling elements may be used to construct the bearing 120.

Furthermore, in the above embodiments, the control unit 30 includes the electric motor 32 to generate the rotational torque. Alternatively, the control unit may include, for example, a hydraulic motor or an electromagnetic brake to generate the rotational torque.

Additional advantages and modifications will readily occur to those skilled in the art. The invention in its broader terms is therefore not limited to the specific details, representative apparatus, and illustrative examples shown and described.

What is claimed is:

1. A valve timing adjusting apparatus that adjusts valve timing of at least one of an intake valve and an exhaust valve of an internal combustion engine, which are opened and closed by a camshaft upon transmission of a torque from a crankshaft to the camshaft, the valve timing adjusting apparatus comprising:

a first rotatable body that includes a first inner gear and is rotated synchronously with one of the crankshaft and the camshaft;

a second rotatable body that includes a second inner gear, which has an axial extent that does not overlap with an axial extent of the first inner gear, wherein the second rotatable body is rotated synchronously with the other one of the crankshaft and the camshaft; and a planet gear that includes a first outer gear and a second outer gear, wherein:

the first outer gear and the second outer gear are meshed with and are driven together with the first inner gear and the second inner gear, respectively, to have a sun-and-planet motion, so that the planet gear changes a relative rotational phase between the first rotatable body and the second rotatable body; and the first rotatable body supports the second rotatable body from a radially inner side of the second rotatable body at a location, which is radially outward of the first inner gear.

2. The valve timing adjusting apparatus according to claim 1, wherein an outer peripheral wall of the first rotatable body is engaged with an inner peripheral wall of the second rotatable body.

3. The valve timing adjusting apparatus according to claim 2, wherein an axial extent of an engaged section between the outer peripheral wall of the first rotatable body and the inner peripheral wall of the second rotatable body at least partially overlaps with an axial extent of the camshaft.

4. The valve timing adjusting apparatus according to claim 1, wherein:

the first rotatable body is supported by and is rotated synchronously with the camshaft; and the second rotatable body is rotated synchronously with the crankshaft.

5. The valve timing adjusting apparatus according to claim 1, wherein the first rotatable body is engaged with at least one specific wall surface of the second rotatable body on a radially outer side of the first inner gear, and the at least one specific wall surface is directed in an axial direction of the valve timing adjusting apparatus.

6. The valve timing adjusting apparatus according to claim 5, wherein:

the at least one specific wall surface of the second rotatable body includes a first wall surface and a second wall surface, which are opposed to each other in the axial direction; and the first rotatable body is clamped between the first wall surface and the second wall surface of the second rotatable body.

7. The valve timing adjusting apparatus according to claim 1, further comprising a planet carrier, which rotatably supports the planet gear from a radially inner side of the planet gear, wherein the planet carrier rotates in a revolving direction of the planet gear.

8. The valve timing adjusting apparatus according to claim 7, further comprising a control unit, which controls a rotational torque applied to the planet carrier.

9. The valve timing adjusting apparatus according to claim 8, wherein the control unit includes an electric motor, which generates the rotational torque.

* * * * *